US011110410B2

(12) United States Patent
Weber et al.

(10) Patent No.: US 11,110,410 B2
(45) Date of Patent: Sep. 7, 2021

(54) STIRRING ELEMENT AND AGITATOR

(71) Applicant: VISCO JET Ruhrsysteme GmbH, Kussaberg (DE)

(72) Inventors: Timo Weber, Waldshut-Tiengen (DE); Christoph Kohlbrenner, Waldshut-Tiengen (DE); Dieter Wassmer, Wutoschingen (DE)

(73) Assignee: VISCO JET RUHRSYSTEME GMBH

( * ) Notice: Subject to any disclaimer, the term of this patent is extended or adjusted under 35 U.S.C. 154(b) by 267 days.

(21) Appl. No.: 16/184,600

(22) Filed: Nov. 8, 2018

(65) Prior Publication Data

US 2019/0134579 A1 May 9, 2019

(30) Foreign Application Priority Data

Nov. 9, 2017 (EP) ..... 17200831

(51) Int. Cl.
*B01F 7/00* (2006.01)
*B01F 7/16* (2006.01)

(52) U.S. Cl.
CPC ..... *B01F 7/1665* (2013.01); *B01F 7/00158* (2013.01); *B01F 7/00516* (2013.01)

(58) Field of Classification Search
CPC ..... B01F 7/1665; B01F 7/00158; B01F 7/00516; B01F 7/005; B01F 7/26; B01F 7/00091; B01F 7/001; B01F 13/005; B01F 13/0052; B01F 7/1655; B01F 7/00166; B01F 7/168; B01F 7/10
See application file for complete search history.

(56) References Cited

U.S. PATENT DOCUMENTS

| | | | | |
|---|---|---|---|---|
| 1,966,352 | A | 7/1934 | Mahony | |
| 3,462,132 | A | 8/1969 | Kaelin | |
| 4,001,077 | A * | 1/1977 | Kemper | B01D 1/0005 159/4.2 |
| 4,465,377 | A * | 8/1984 | de Bruyne | B01F 13/0863 366/273 |
| 5,584,657 | A * | 12/1996 | Scarfer | F03D 1/0633 416/144 |
| 6,264,356 | B1 | 7/2001 | Boerner | |
| 2015/0191276 | A1 * | 7/2015 | Rottman | B01F 11/0005 241/179 |

FOREIGN PATENT DOCUMENTS

| | | | |
|---|---|---|---|
| DE | 2730390 | A1 | 1/1979 |
| DE | 3 901 894 | A1 | 8/1989 |

(Continued)

OTHER PUBLICATIONS

The above documents were cited in a May 17, 2019 Russian Office Action/Search Report, which are enclosed without an English Translation, that issued in Russian Patent Application No. 2018139282/05.

*Primary Examiner* — Anshu Bhatia
(74) *Attorney, Agent, or Firm* — Cowan, Liebowitz & Latman, P.C.; Mark Montague

(57) ABSTRACT

The invention relates to a stirring element of a stirrer for mixing and/or homogenizing or suspending flowable media, which is substantially spherical in shape. The invention further relates to a stirrer having at least two stirring elements according to the invention.

7 Claims, 1 Drawing Sheet

(56) References Cited

FOREIGN PATENT DOCUMENTS

| | | | |
|---|---|---|---|
| DE | 3901894 | A1 | 8/1989 |
| FR | 1479166 | A | 4/1967 |
| RU | 1782765 | C | 12/1992 |
| RU | 1723716 | C | 11/1994 |
| SU | 1706684 | A1 | 1/1992 |

* cited by examiner

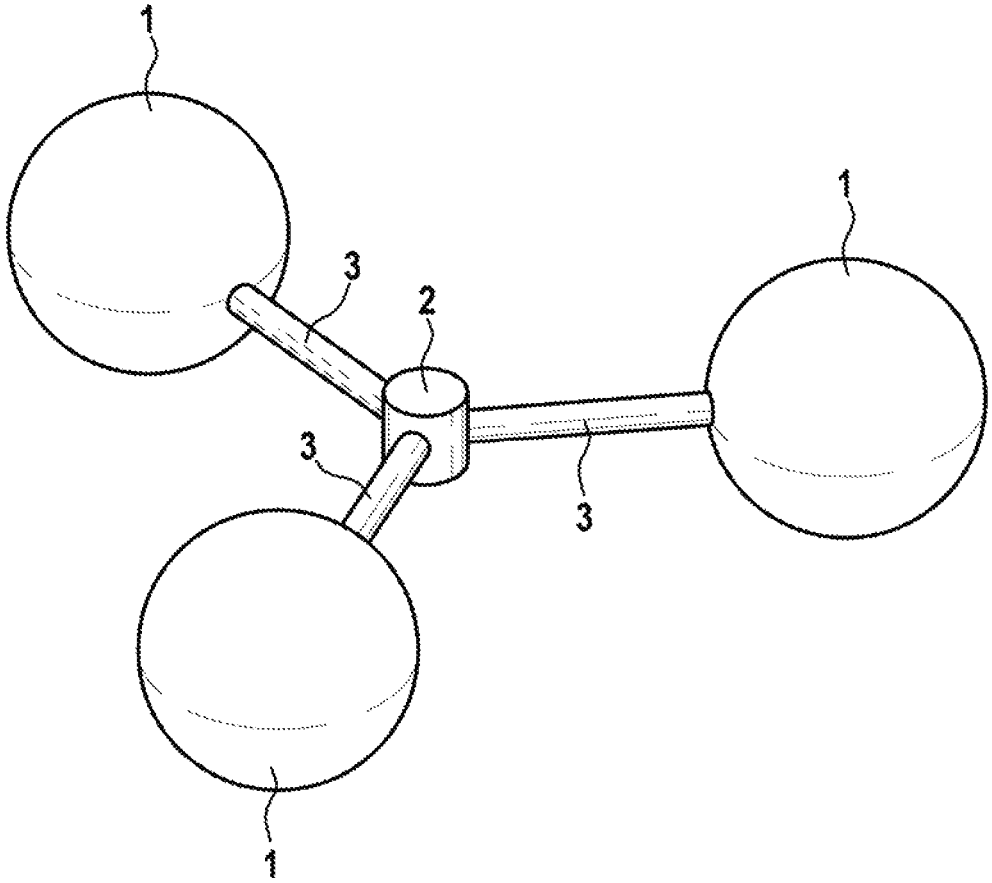
1
1
3
2
3
3
1

STIRRING ELEMENT AND AGITATOR

The invention relates to a stirring element of a stirrer for mixing and/or homogenizing or suspending flowable media.

The invention further relates to a stirrer for mixing and/or homogenizing or suspending flowable media having at least two such stirring elements.

Stirrers are used in a wide variety of fields of application. Examples of possible fields of application are the production of paints and varnishes or the production of beverages and food products. The production of pharmaceutical products and cosmetics, as well as the production of paper and ceramics, frequently requires the use of stirrers as well. The stirrer arrangements that are used to mix and/or homogenize or suspend the respective substances differ depending on the respective field of application. Known are barrel and container stirrers, for example, which are disposed in or on the respective container, or self-supporting stand stirrers. In order to prevent separation during storage or transport, small to large volume containers for storing or transporting material mixtures can also be equipped with a stirrer. The stirrer is matched to the particular material to be stirred and to the shape and size of the respective container.

Stirrers generally comprise a rotary shaft which can be driven by an electric motor, by means of which one or more stirring elements which are rotationally fixedly connected to the rotary shaft are moved on a circular path. When used in a container filled with a flowable medium, the medium flows around the stirring elements as a result of their movement. Depending on the shape of the stirring elements, the arrangement thereof in the container and the speed at which the stirring elements are moved, specific flow conditions are created in the stirred material that cause the material to be mixed.

The stirring elements known from the state of the art generally comprise tubular bodies through which the mixed material flows.

Cup stirrers, for example, have been known for a long time. Such stirrers subject the mixed material to sharp changes in the flow velocity, which leads to relatively large amounts of mechanical stress on the mixed material. The usefulness of such stirrers for sensitive mixed materials is limited. Further developments of these stirrers often comprise stirring elements with a relatively complicated design, but still hold on to the principle that the mixed material flows through the stirring element.

A stirrer, which is intended to make a complete mixing of a flowable medium possible at a relatively low speed of movement of the stirring elements, is known from DE 39 01 894 A1. The stirrer should therefore also be suitable for the treatment of sensitive material mixtures. The stirrer comprises a shaft with arms that extend perpendicular to the longitudinal axis of the shaft; each of which holds a stirring element at its free end. Each stirring element consists of a tubular body which is designed to at least partially have a conical shape. The conical shape causes the flow cross section of the tubular body to decrease in flow direction, i.e. counter to the direction of rotation, and consequently causes an increase in the flow velocity of a through-flowing stirred material.

The longitudinal axis of the stirring element is additionally slanted downward in the direction of rotation. Therefore, in the start-up phase, the stirred material flows through the stirring elements in a laminar fashion. As soon as a predetermined minimum speed is achieved, however, dynamic pressure forces the flow inside the stirring elements to reverse. The resulting counter flow should have the effect that, already at low power consumption of the drive, i.e. at low speeds of movement of the stirring elements, an expansive and nonetheless gentle stirring effect can be achieved.

DE 201 16 967 U1 further discloses a stirring body for an apparatus for stirring flowable media, the design of which is intended to make improved mixing of the stirred material possible. The stirring body is in particular intended to be suitable for stirring or mixing highly viscous flow media or highly viscous flowable stirred material. For this purpose, the stirring body comprises an outer wall and a base at one end of the outer wall, wherein the base has at least one opening as a flow cross section for the stirred material. The outer wall captures a partial flow of the stirred material, which experiences a change in direction when it strikes the base. The change in direction causes turbulence in the stirred material, in particular laterally in front of and behind the stirring body. The turbulence in turn has the effect that a thorough mixing of the stirred material takes place.

DE 10 2006 043 498 A1 discloses a dispersion machine for producing powder mixtures having a rotor and stator element pair, which are configured in a mirror-inverted manner and formed such that a slot-shaped working volume is created between the rotor and the stator, through which the powder suspension flows during operation of the dispersion machine. Shear forces, which bring about good mixing and/or homogenization of the powder suspension, are thereby introduced into the powder suspension via the rotations of the rotor.

The proposed dispersion machine is intended to, in particular, be suitable for producing homogeneous suspensions in the production of hard metals and cermets.

The mentioned stirrers are limited in terms their usable rotational speed. At high rotational speeds, the stirring effect drops sharply. The power input is therefore limited, which is disadvantageous, for example, when introducing gas, dispersing, emulsifying or taking powder in.

Based on the abovementioned state of the art, the object of the present invention is to specify a stirring element or a stirrer having such stirring elements, which, with a simple design, provides improved power input.

To achieve this objective, the invention proposes a stirring element having the features of claim 1 and a stirrer having the features of claim 5. Advantageous further developments of a stirring element according to the invention or a stirrer according to the invention are specified in the respective subclaims.

The stirring element according to the invention is spherical. In the context of the invention, this is understood to mean the following:

- The stirring element has an outer surface that is essentially (predominantly) curved. The outer surface is preferably curved overall, i.e. has no edges and no points. The stirring element is essentially a round body.
- The outer surface is closed (i.e. has no openings so that only the outside of the stirring element (the outer surface) comes into contact with the mixed material. This does not preclude the occurrence of concavities or the like of the outer surface, if the configuration of the stirring element is not strictly spherical.
- The stirring element can, but does not have to, be symmetrical. In terms of geometry, the stirring element is preferably spherical; it can, however, also be an ellipsoid or a non-symmetrical, similar round body.
- If the stirring element is not strictly spherical, it has a maximum radius and a minimum radius, wherein the maximum radius is greater than the minimum radius. The size difference between these radii is preferably not greater than 5, and particularly preferably the maximum radius is less than twice as large as the minimum radius.

The stirring element can be a hollow body or consist of solid material.

The invention is thus fundamentally different from the concept of flow-through stirring elements. In the solutions with tubular body stirring elements known in the state of the art, the mixed material is induced to mix by means of an acceleration and a redirection of the created flow at the container wall. This is primarily achieved by means of overpressure, i.e. by means of pressure forces. Stirrers having spherical stirring elements in the sense of the invention appear to not yet to be known.

In the stirring element according to the invention, the shape of said stirring element causes overpressure in the direction of movement in front of the stirring element, an acceleration of the mixed material around the outside of the stirring element, and underpressure in the mixed material in the direction of movement behind the stirring element. Since the mixed material is practically incompressible, and is directed out of the region of overpressure in front of the stirring element into the region of underpressure behind the stirring element very quickly, a suction or an expansion effect is created on the mixed material, which contributes to breaking up the structure of the mixed material and promotes mixing.

In doing so, due to the shape of the stirring element, the mixing of the mixed material is very gentle. Shear stresses are largely avoided. Material that settles in the container is very effectively, but gently, removed and stirred up without the use of significant shear forces, particularly due to the region of underpressure behind the stirring element.

The design of the stirrer according to the invention makes it possible to work very close to the wall without the risk of damaging the container wall. The stirrer according to the invention is furthermore easy to clean, especially since no mixed material can settle in the closed stirring elements.

The stirrer according to the invention allows an improved introduction of gas into the product, because, due to the substantially non-directional flow in the product, hardly any larger gas bubbles form.

A plurality of stirring elements preferably have the same shape and the same size.

The stirring elements are preferably all fastened, spaced apart, to the rotary shaft of the stirrer by means of support arms. Likewise preferred is an arrangement of all the stirring elements at the same distance to the rotary shaft and at the same distance from one another, i.e. in the sense of a symmetrical "star-shaped" arrangement around the rotary shaft.

The invention also proposes a stirrer for mixing and/or homogenizing or suspending flowable media, having at least two stirring elements according to the invention, wherein each stirring element is connected to a hub via a support arm for connection to a drivable rotary shaft.

The preferred arrangement of the stirring elements is one that is symmetrical with respect to the axis of rotation of the stirrer. It is furthermore preferred that all the stirring elements are arranged at the same distance to the axis of rotation of the stirrer.

The support arms provided for connecting the stirring elements to the drivable rotary shaft are preferably arranged at the same angular distance to one another and in a common radial plane. In other words, the extension of the support arms is preferably radial.

A preferred embodiment of the invention is discussed in more detail in the following with the aid of the drawing. The drawing shows:

FIG. 1 a perspective three-dimensional view of a stirrer according to the invention.

The stirrer of FIG. 1 comprises three stirring elements 1 according to the invention, each of which is connected to a hub 2 via a support arm 3.

In this design example, the stirring elements 1 are spherical. They are formed by spherical hollow bodies made of metal or plastic, each of which is attached to a radially outward end of a support arm 3.

During operation, the hub 2 is coaxially connected to the not depicted rotary shaft of the stirrer for the purpose of joint rotation about the axis of rotation of the stirrer. Therefore, during operation, the stirrers move on a common circular trajectory around the rotary shaft.

The invention is not restricted to the embodiment shown in FIG. 1. In particular the number of stirring elements 1 as well as their cross-sectional shape and their arrangement relative to one another can vary. The invention is furthermore not restricted to the dimensions selected in the drawing. The respective specific dimensions emerge as a function of the intended field of application and are in particular adapted to the size of a container accommodating the stirred material.

The invention claimed is:

1. A stirrer for mixing and/or homogenizing or suspending flowable media, comprising two or more stirring elements, characterized in each of the stirring elements is mounted to a driveable rotary shaft by a support arm and rotates together with the drivable rotary shaft, each of the stirring elements being spherically configured as a round body, and comprising a closed outer surface and being arranged at the same angular distance to one another and in a common radial plane further comprising a hub, each stirring element is connected to the hub via one of the support arms, the hub connecting the support arms to the drivable shaft.

2. Stirrer according to claim 1, characterized in that the outer surface of each the stirring elements has no edges or points.

3. Stirrer according to claim 1, characterized in that each of the stirring elements is a hollow body, preferably made of metal or plastic.

4. Stirrer according to claim 1, characterized in that the stirring elements are disposed symmetrically at the same distance to the drivable rotary shaft.

5. Stirrer according to claim 1, characterized in that the stirring elements have the same size and the same shape.

6. Stirrer according to claim 1, characterized in that the stirring elements are movable on a circular path around the drivable rotary shaft.

7. Stirrer for mixing and/or homogenizing flowable media, having three stirring elements according to claim 1, characterized in that the three stirring elements are fastened, spaced apart, to the drivable rotary shaft by the support arm.

* * * * *